US005112265A

United States Patent [19]

Naum

[11] Patent Number: 5,112,265

[45] Date of Patent: May 12, 1992

[54] TOY ANIMAL HAVING OSCILLATING PARTS

[76] Inventor: Elena D. Naum, 1212 N. Graycroft, Madison, Tenn. 37115

[21] Appl. No.: 642,433

[22] Filed: Jan. 17, 1991

[51] Int. Cl.[5] ..... A63H 3/46; A63H 3/02; A63H 13/18

[52] U.S. Cl. ..... 446/384; 446/371; 446/326

[58] Field of Search ..... 446/384, 383, 382, 376, 446/373, 375, 371, 370, 369, 325, 326, 396, 351, 129, 133, 137, 139

[56] References Cited

U.S. PATENT DOCUMENTS

| | | | |
|---|---|---|---|
| 1,008,619 | 11/1911 | Spear | 446/384 |
| 3,273,280 | 9/1966 | Karton | 446/391 X |
| 4,274,224 | 6/1981 | Pugh et al. | 446/383 X |
| 4,662,857 | 5/1987 | Quinn et al. | 446/384 X |
| 4,696,656 | 9/1987 | Torres et al. | 446/384 X |

FOREIGN PATENT DOCUMENTS

| | | | |
|---|---|---|---|
| 449992 | 7/1948 | Canada | 446/383 |
| 400362 | 8/1924 | Fed. Rep. of Germany | 446/383 |
| 435848 | 10/1926 | Fed. Rep. of Germany | 446/383 |
| 2258838 | 6/1974 | Fed. Rep. of Germany | 446/139 |
| 530337 | 7/1955 | Italy | 446/382 |
| 1056370 | 1/1967 | United Kingdom | 446/384 |

*Primary Examiner*—Robert A. Hafer
*Assistant Examiner*—D. Neal Muir
*Attorney, Agent, or Firm*—Harrington A. Lackey

[57] ABSTRACT

A toy animal having a main body part and an oscillating body part movably mounted upon the main body part by a mounting mechanism which will permit the oscillating body part to have relative rotary and oscillating movement relative to the main body part when a small force or vibration is imparted to the main body part. The oscillating body part could be the toy animal's head mounted upon the neck portion of the main animal body part to permit the head to rotate about a vertical axis and also to oscillate or vibrate relative to the main body part.

7 Claims, 1 Drawing Sheet

TOY ANIMAL HAVING OSCILLATING PARTS

BACKGROUND OF THE INVENTION

This invention relates to a toy animal having relatively movable parts, and more particularly to a toy animal having an oscillating body part mounted for rotary and oscillating movement about the main body part of the toy animal.

Toy animals and dolls that have various moving parts, such as heads, legs and arms, are well known. However, such toy animals and dolls usually have rather complicated structure for permitting such relative movement between the various parts of the toys.

Examples of some of these toy animals and dolls having relatively movable parts are shown in the following U.S. Pat. Nos.:

| | | |
|---|---|---|
| 2,128,326 | Rubenstein | Aug. 30, 1938 |
| 3,462,877 | Lang | Aug. 26, 1969 |
| 3,465,474 | Gardel et al | Sep. 9, 1969 |

The Rubenstein patent discloses an oscillating or wagging tail mounted on the body part of a toy animal.

The Lang patent discloses a toy dog having its head rotatably mounted for rotary movement about a single axis relative to the body of the toy dog.

The Gardel et al U.S. Pat. No. 3,465,474 discloses a doll having a head mounted on the body of the doll which is adapted to rotate or oscillate through several degrees of movement, such as the three degrees of movement disclosed in FIGS. 1, 2, and 3 of the Gardel et al patent. The structure of the mechanism for mounting the head on the body of the doll is unusually complex in order to permit the three degrees of movement with limits for such movement.

SUMMARY OF THE INVENTION

The toy animal made in accordance with this invention includes the main body part of the toy animal and an oscillating or movable body part, such as the head of the animal and a mechanism for mounting the head on the main body part in such a manner that when a slight force or vibration is imparted to the main body part of the animal, the head oscillates or vibrates. The head is also mounted in such a manner that it may be rotated relative to the body part.

In order to provide a rotary and oscillating relative motion between the oscillating body part and the main body part of the toy animal, a mounting mechanism is provided including a standard projecting upward from the main body parts, fixedly supporting a spherical bearing support. The bearing support is received within a mounting chamber having an open bottom end within the oscillating body part and is loosely coupled to the top wall of the chamber in such a manner that the spherical bearing support engages a flat bearing surface in the top of the mounting chamber for free rotary and oscillatory movement when an initial force or jar is imparted to the main body part of the toy animal.

Another object of this invention is to provide a mounting means for supporting an oscillatory toy animal body part for movement relative to the main body part of the toy animal, all of which body parts are supported upon an elongated common base member within the main body part to which is also affixed a device to permit oscillation of another body part. The initial oscillating body part may be the head of a toy animal, while a second oscillating body part may be the tail of the toy animal.

DESCRIPTION OF THE PREFERRED EMBODIMENTS

Figure 1:
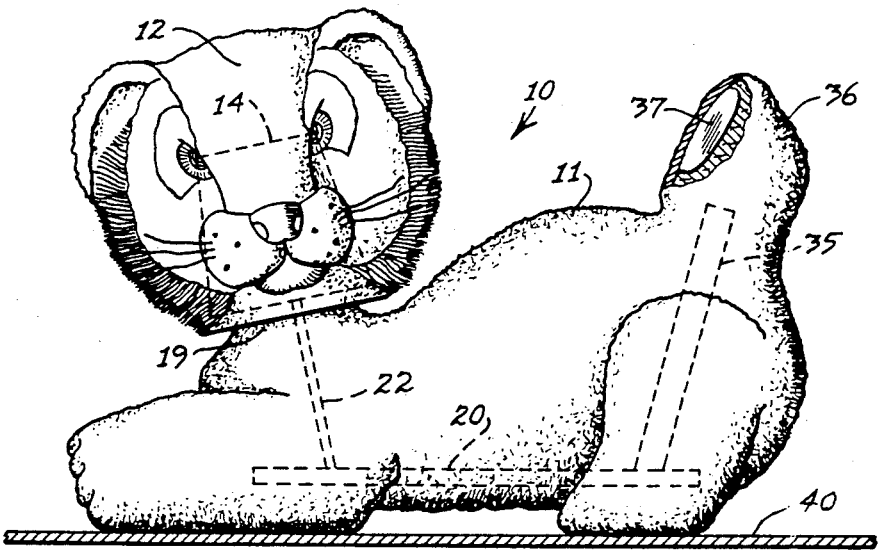
FIG. 1 is a side elevational view of a toy animal incorporating the mounting mechanisms for oscillating body parts upon the main body part of the animal.
Figure 2:
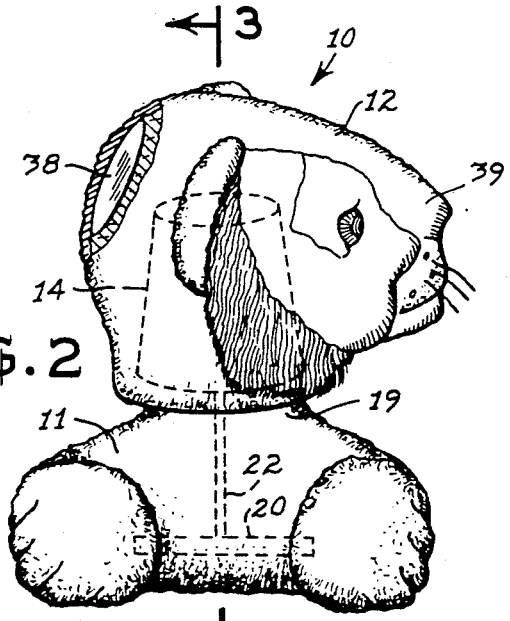
FIG. 2 is a front elevational view of the toy animal disclosed in FIG. 1.

Referring now to the drawings in more detail, FIGS. 1 and 2 disclose a toy animal 10, such as a stuffed toy tiger including a main body part incorporating the main body 11 and the fore and rear paws of the tiger.

Supported upon the main body part 11 for movement relative to the main body part 11 is an oscillating body part, such as the head 12 of the tiger. The oscillating body part or head 12 includes a hollow mounting chamber 13 formed by an inverted cup-like member 14 having an open bottom end 15. The inverted cup member 14 also includes a substantially flat, and preferably circular, top wall 16 surrounded by a substantially frustoconical side wall 17. The inverted cup member 14 is imbedded in the oscillating body part or head 12 and held in place by the stuffing 18 filling the toy animal head 12. The inverted cup member 14 is held in place so that the mounting chamber 13 defined by the inverted cup member 14 has its bottom end 15 opening downward and in substantially coaxial or vertical alignment with the axis of the neck piece 19 of the main body part 11.

Extending the length of the bottom portion of the main body part 11 is an elongated, relatively heavy, base member 20. The base member 20 is held in position within the main body part 11 by the stuffing 21 in the main body part 11, so that the base member 20 extends fore and aft of the direction of the main body part 11.

Figure 4:
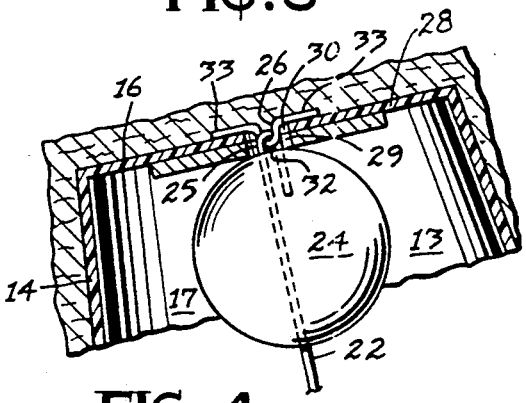
FIG. 4 is an enlarged, fragmentary, sectional elevation of a portion of the mounting mechanism for supporting the oscillating body part upon the toy animal.

Projecting upward from the front portion of the base member 20 is an elongated standard 22, which projects coaxially through the neck piece and into the mounting chamber 13. The upper portion of the standard 22 projects through a spherical bearing member or support 24, as best disclosed in FIG. 4. The upper portion of the standard 22 projects slightly beyond the upper surface of the spherical support 24 and is bent back upon itself to form a hook member 25, as best described in FIG. 4. The hook member 25 forms one part of a loose coupling mechanism inter-engaging a depending loop member 26. As disclosed in FIG. 4, the flat bearing plate or disc 28 is fixedly secured concentrically to the inner surface of the top wall 16, and defines a center hole 29 through the bearing disc 28, which registers with the central hole 30 in the top wall 16 of the inverted cup member 14. The center hole 29 and the central hole 30 are preferably of equal size or diameter and large enough to freely receive the hook member 25 and the loop member 26 when inter-engaging each other.

Furthermore, the spherical bearing support 24 is formed on the top portion of the standard 22 in such a manner that it normally effects rolling contact with the bottom surface of the bearing plate 28. Because of the spherical shape of the bearing support 24 and the planar surface of the bearing plate 28, rolling contact is effected between the two bearing members 24 and 28. Thus, the least force or jar imparted to the toy animal will cause the oscillating body part or head 12 to oscillate or "jiggle" relative to the main body part 11. This relative oscillating movement is permitted by the inter-engagement of the spherical bearing support 24 and the flat bearing plate 28, as well as the loose coupling between the hook member 25 and the loop member 26.

Furthermore, the loop member 26 is formed of a central depending loop portion 32 and a pair of ears 33 projecting diametrically in opposite directions so that the ears 33 span the central hole 30 and are substantially sandwiched between the top surface of the top wall 16 and the stuffing 18. However, this positioning of the ears 33 between the top wall 16 and the stuffing 18 still permits the oscillating body part 12, including the inverted cup member 14 and the bearing disc 28, to rotate relative to the spherical bearing support 24 and the mast or standard 22, so that the body part 12 may rotate about the axis of the standard 22 relative to the stationary main body part 11.

Figure 5:
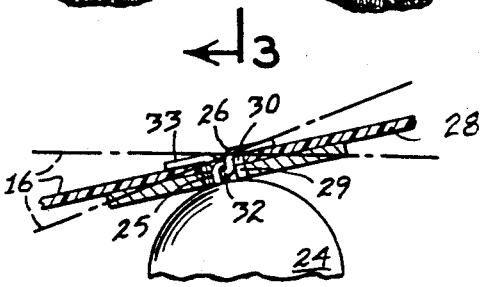
FIG. 5 is an enlarged schematic side elevational view of the cooperating bearing parts disclosed in FIG. 4, in several operative positions.

Thus, the oscillating body part 12 or head is permitted free oscillatory movement about the main body part 11, such as illustrated by the different positions of the bearing disc 28 in FIG. 5, as well as rotary movement about the substantially vertical axis of the standard 22. The vertical rotary movement may be obtained by merely grasping the head or oscillating body part 12 and physically rotating the head relative to the main body part 11.

Figure 3:
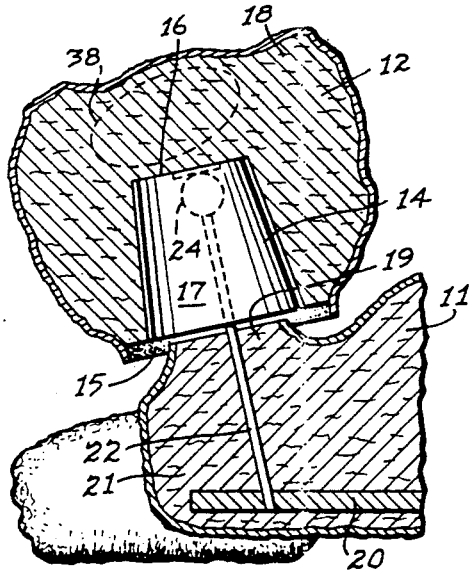
FIG. 3 is a fragmentary, sectional elevation taken along the line 3—3 of FIG. 2.

As illustrated in FIGS. 1, 2, and 3, the open bottom end portion 15 of the oscillating body part 12 does not project too far downward relative to the neck piece 19, so that there is sufficient clearance, not only for the vertical rotary movement of the head 12 about the main body part 11, but also the tilting or jiggling, or oscillating movement of the head 12 about the main body part 11.

Projecting upward and slightly rearward from the rear portion of the base member 20 is an elongated tail post 35 extending the base of the flexible tail member 36, as best illustrated in FIG. 1. The tail member 36 is filled with just enough stuffing to permit sufficient flexibility that the tail member 36 will vibrate or oscillate when the animal 10 is jarred. The tail post 35 is rigid so that only the tail member 36 will oscillate.

In order to counter balance the weight of the stuffed flexible tail member 36, a tail counterweight 37 may be mounted in the forward portion of the tail member 36, as illustrated in FIG. 1.

In a similar manner, the weight of the stuffed head 12 is maintained in generally neutral balance by the insertion of a head counterweight 38 in the back of the head 12, which will offset the weight of the face or nose 39 of the toy animal head 12.

The main body part 11 and the oscillating body part 12 are made of conventional stuffed toy animal materials. The inverted cup member 14 defining the mounting chamber 13 is preferably made of plastic. The flat bearing plate 28 may also be made of plastic having a hard wearing surface. Moreover, the spherical support member 24 may also be made of plastic having a smooth spherical surface for minimum frictional contact with the bearing plate 28.

The standard 22, as well as its hook member 25 and its inter-engaging loop member 26 may be made of metal, such as metal wire.

The base member 20 may be made of a flat steel bar, wood or plastic, while the tail post 35 may also be made of plastic or wood.

The toy animal 10 may be placed on a flat surface 40, such as the rear shelf of an automobile, and whenever the sudden movements of the automobile impart a jar or change in force upon the main body part 11, the animal part 12 will be free to jiggle or vibrate relative to the main body part 11. Moreover, simultaneously, the tail member 36 may vibrate or jiggle because of its flexibility, relative to the main body part 11.

Thus, the toy animal 10 is capable of producing these various oscillating and rotary motions for entertainment, and decoration.

What is claimed is:

1. A toy animal comprising:

(a) a main body part having upper and lower portions, (b) an oscillating body part having upper and lower portions, (c) mounting means connecting said oscillating body part to said main body part, (d) said mounting means comprising an elongated standard fixed to said main body part and projecting upward from said main body part, (e) a spherical bearing support fixed on said standard, (f) a mounting chamber within said oscillating body part having a top wall and a bottom opening, (g) said top wall comprising a flat bearing surface, and (h) coupling means loosely connecting said spherical bearing support to said top wall within said mounting chamber for rotary and rolling engagement between said spherical bearing support and said flat bearing surface.

2. The invention according to claim 1 in which the spherical bearing support has a top portion and in which said coupling means comprises a loop member projecting downward from said top wall, and a hook member fixed to the top portion of said spherical bearing support and engaging said loop member loosely to permit rocking movement of said spherical bearing support against said flat bearing surface.

3. The invention according to claim 2 further comprising means for supporting said loop member in said top wall for rotary movement about an axis perpendicular to said flat bearing surface, to permit relative rotatable movement of said spherical bearing support about said flat bearing surface.

4. The invention according to claim 1 in which said main body part comprises a neck portion and said oscillating body part comprises the head of a toy animal, said elongated standard fixed to and projecting upward from said neck portion.

5. The invention according to claim 4 in which said head includes a face portion and a back portion, said face portion projecting laterally farther away from said neck portion relative to the rotary axis of said animal head, and further comprising a head counterweight mounted within the back portion of said animal head to offset the weight of said face portion.

6. The invention according to claim 4 further comprising a tail portion projecting upward from said main body part spaced from said neck portion, an elongated, rigid base member extending longitudinally within said main body part below said neck portion and said tail portion, said standard being fixedly mounted within said base member, a tail post projecting upward from said base member within said main body part toward said tail portion, said tail portion being sufficiently flexible to bend relative to said tail post.

7. The invention according to claim 6 in which said flexible tail portion is normally eccentrically weighted toward the rear of said main body part, and further comprising a tail counterweight formed in said tail portion to balance the normally eccentric weight of said tail portion.

* * * * *